US005625931A

United States Patent [19]

Visser et al.

[11] Patent Number: 5,625,931

[45] Date of Patent: May 6, 1997

[54] RESILIENT CLAMP

[76] Inventors: Steven C. Visser, 271 E. Sunset La., West Lafayette, Ind. 47906; Kyle M. Bennett, 42 Rock Island St., Gouverneur, N.Y. 13642

[21] Appl. No.: 515,565

[22] Filed: Aug. 16, 1995

[51] Int. Cl.[6] ..... A44B 21/00

[52] U.S. Cl. ..... 24/557; 24/508; 24/545

[58] Field of Search ..... 24/557, 508, 511, 24/501, 540, 507, 545

[56] References Cited

U.S. PATENT DOCUMENTS

| | | | |
|---|---|---|---|
| 3,204,313 | 9/1965 | See | 24/557 |
| 3,282,137 | 11/1966 | Lovelace . | |
| 3,317,973 | 5/1967 | Finkle | 24/511 |
| 3,398,746 | 8/1968 | Abramson . | |
| 3,402,442 | 9/1968 | Kruger et al. | 24/557 |
| 3,616,497 | 11/1971 | Esposito, Jr. | 24/557 |
| 4,079,765 | 3/1978 | Hatayan | 24/545 |
| 4,192,204 | 3/1980 | Feldman . | |
| 4,698,051 | 10/1987 | Jacobson . | |
| 5,402,558 | 4/1995 | Santapa | 24/501 |
| 5,414,911 | 5/1995 | Adams | 24/557 |

FOREIGN PATENT DOCUMENTS

| | | | |
|---|---|---|---|
| 2501417 | 7/1975 | Germany . | |
| 0165200 | 11/1958 | Sweden | 24/557 |
| 0398487 | 3/1966 | Switzerland | 24/557 |
| 0610897 | 10/1948 | United Kingdom | 24/508 |

*Primary Examiner*—Victor N. Sakran
*Attorney, Agent, or Firm*—Foley & Lardner

[57] ABSTRACT

A clamp, such as a resilient clamp, is characterized by a pair of elongated members each having a force applying end and an opposed working end. The members are resiliently interconnected by a plurality of substantially arcuately-shaped bands in a region of the members intermediate the working ends and the force applying ends, defining a bight facing the working ends.

25 Claims, 3 Drawing Sheets

FIG. 1
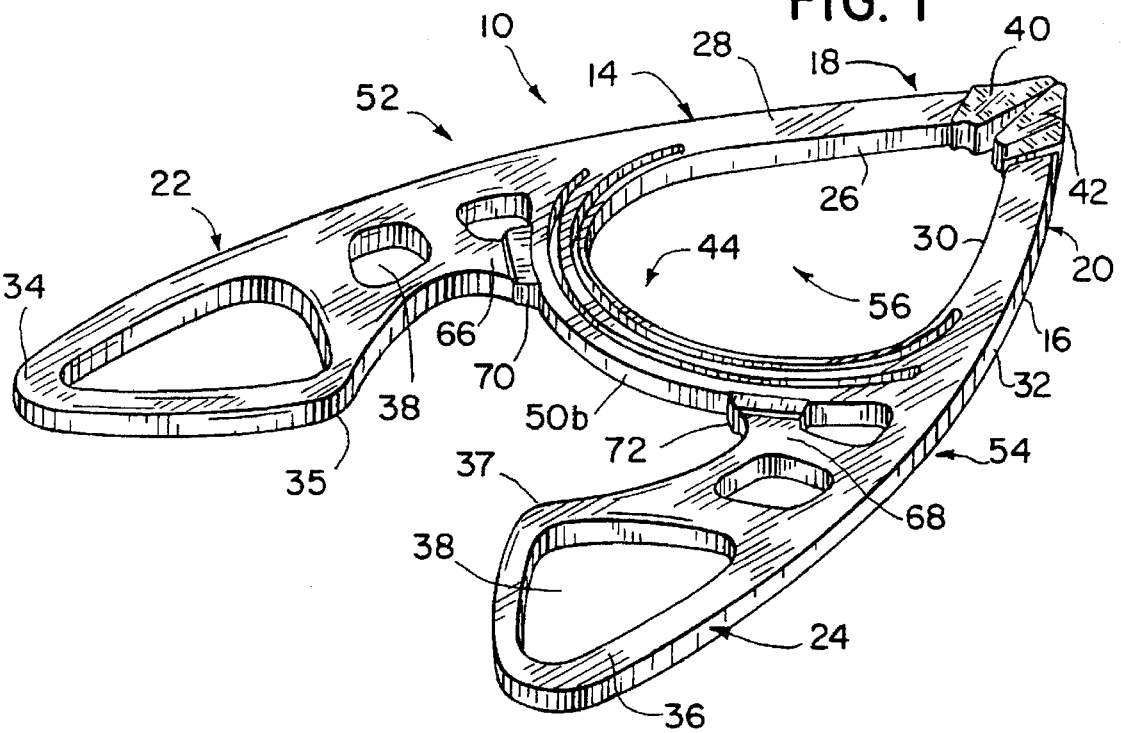
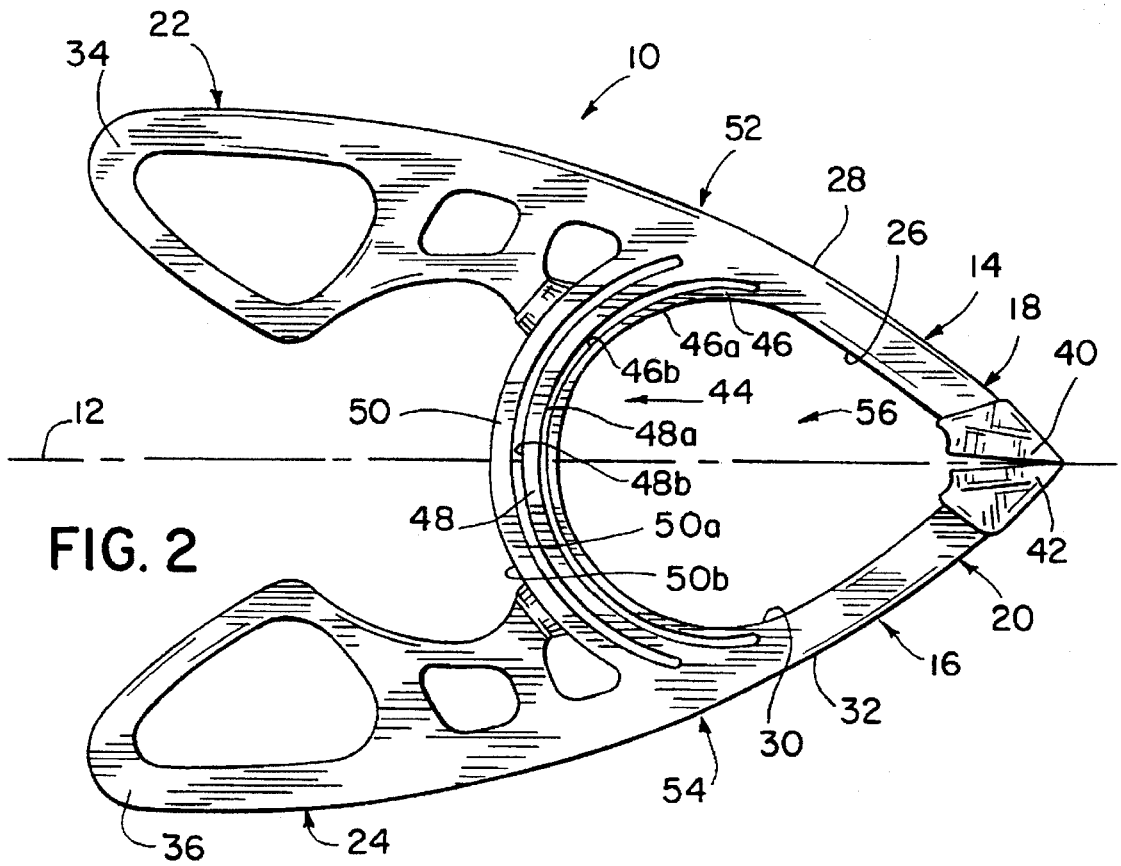
FIG. 2

FIG. 3
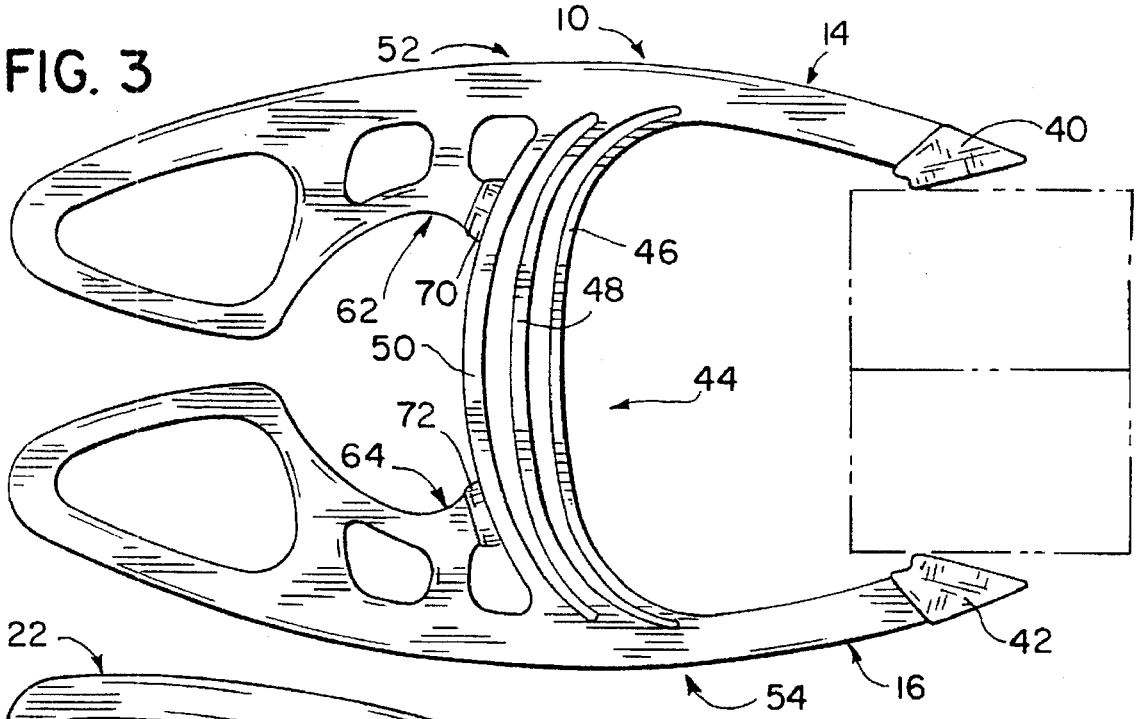
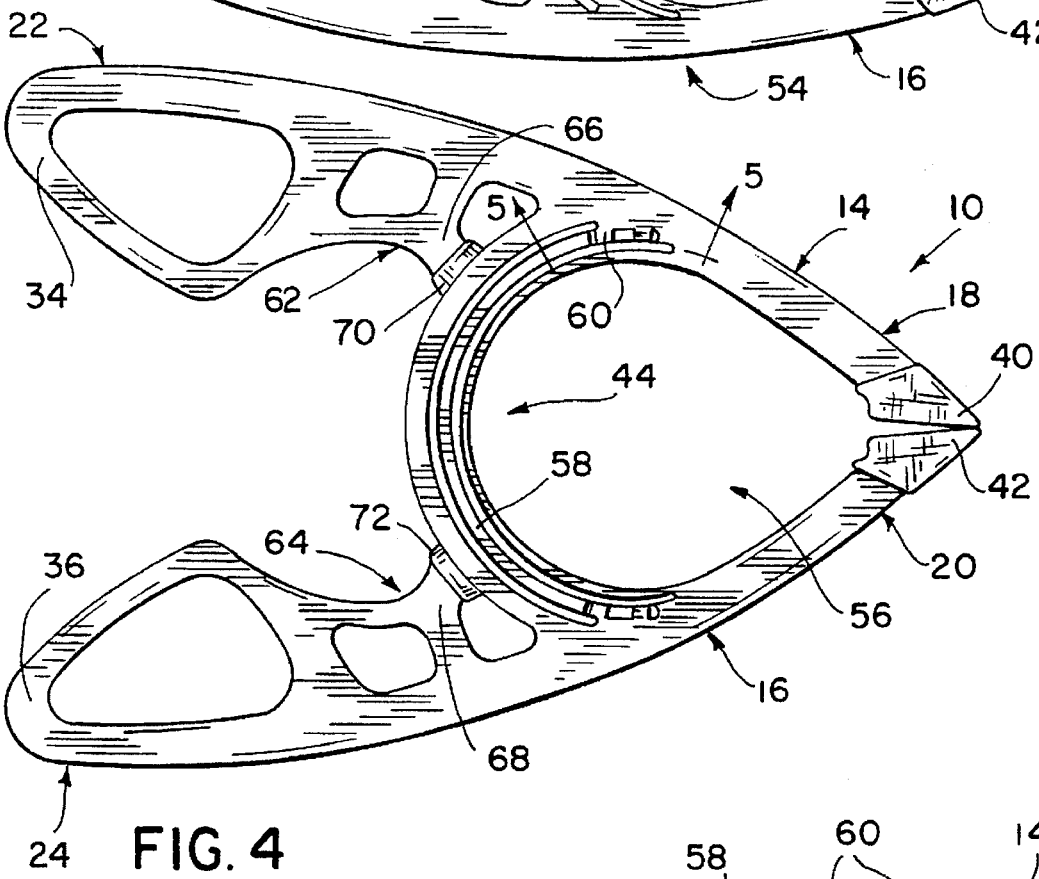
FIG. 4
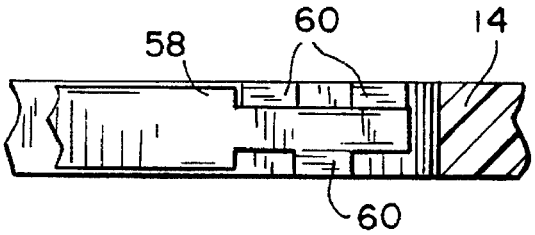
FIG. 5

RESILIENT CLAMP

FIELD OF THE INVENTION

The present invention relates generally to clamps configured to hold various objects between a pair of jaws, and more particularly to resilient clamps that are designed to assist hobbyists and the like by gently holding objects temporarily for assembly and detailing.

BACKGROUND OF THE INVENTION

Clamps and other work piece holding implements are widely used and take various forms depending on their application. As illustrated in U.S. Pat. No. 3,802,437 issued Apr. 9, 1974 to Kees, a clamp or clip 20 is designed to be positioned on a blood vessel. Clip 20 comprises a pair of pivotally connected and generally arc-shaped jaws 39, 41, that are biased in a closed position by a wire spring 49. While the jaws of this blood clamp are conveniently formed to conform generally to blood vessels, those skilled in the art will readily appreciate that a clamp of the type disclosed in Kees can be reconfigured for other applications simply by changing the shape of the jaws. In all such cases, however, these structures would necessarily include various components thereby increasing manufacturing costs.

Clamps of simpler construction are, however, also well know in the art. For example, and in connection with a totally different application, a rack clip is disclosed in U.S. Pat. No. 4,899,966 issued on Feb. 13, 1990 to Antos. In that case the clamp is designed to hold work pieces between a pair of suitably configured contacts 22, 24. As in Kees, the clamp includes a coiled portion which is biased in a manner so that the spring tension stored in the clamp forces the pair of contacts together. In Antos, however, the clamp is simply made of spring wire to which a handle of simple construction and a pair of contacts have been soldered. As shown by Antos, clamps of simple construction are known, but they are commonly used in applications where gentle holding of the work piece is not a concern.

Those skilled in the art will most likely already be familiar with other clamps such as "C-shaped" clamps and "bar clamps". In addition to comprising typically several distinct components, those other more commonly used clamps normally require the use both hands first to position the clamp about the work piece, and then, while attempting to maintain the work piece within the clamp, to tighten the clamp as required. As can be readily appreciated, this two-handed operation may, at times, present difficulties and require unusual dexterity.

The foregoing makes apparent that prior art holding devices such as clamps or the like, have various disadvantages. Some of these prior art items include several components which require separate manufacturing steps followed by assembling operations. Others, while generally of simpler construction, cannot typically perform precise and gentle holding operations. Yet others, which may be suitable for use with delicate objects, may be of a construction which makes them more difficult to use. Thus, it is desirable to provide a clamp or the like having improved characteristics and versatility to attempt to alleviate the problems associated with conventional prior art items, but which is nonetheless engineered to facilitate its fabrication, at the same time improving, or at least maintaining, its reliability and relatively low cost.

SUMMARY OF THE INVENTION

A clamp according to the present invention includes a pair of interconnected elongated members, each member having a working end configured as a jaw, and an opposed force applying end. According to one aspect of the invention, the members are interconnected by a plurality of arcuately-shaped bands resiliently joining the members in a region of the members intermediate the working ends and the force applying ends.

According to another aspect of the invention, at least one of the bands includes a metal spring.

According to yet another aspect of the invention, the clamp also includes a pair of braces cooperating with the bands to permit larger clamp opening.

According to a preferred embodiment of the present invention, the bands and members are formed as a unitary piece made of a moldable material such as plastic. Such a novel unitary clamp permits one handed operation, thereby facilitating its use and making it more versatile, and comprises a limited number of components making it easier to manufacture.

BRIEF DESCRIPTION OF THE DRAWINGS

The preferred exemplary embodiment of the invention will hereinafter be described in conjunction with the appended drawings, wherein like numerals denote like elements and:

FIG. 1 is a perspective view of a first embodiment of a clamp in accordance with the invention, the clamp being shown in closed configuration;

FIG. 2 is a front elevational view of the clamp of FIG. 1;

FIG. 3 is a front elevational view of the clamp of FIG. 1 shown in the open position;

FIG. 4 is a front elevational view of a clamp in accordance with a second embodiment of the invention;

FIG. 5 is a partial sectional view taken along line 5—5 shown in FIG. 4.

DETAILED DESCRIPTION OF A PREFERRED EXEMPLARY EMBODIEMENT

Figure 6:
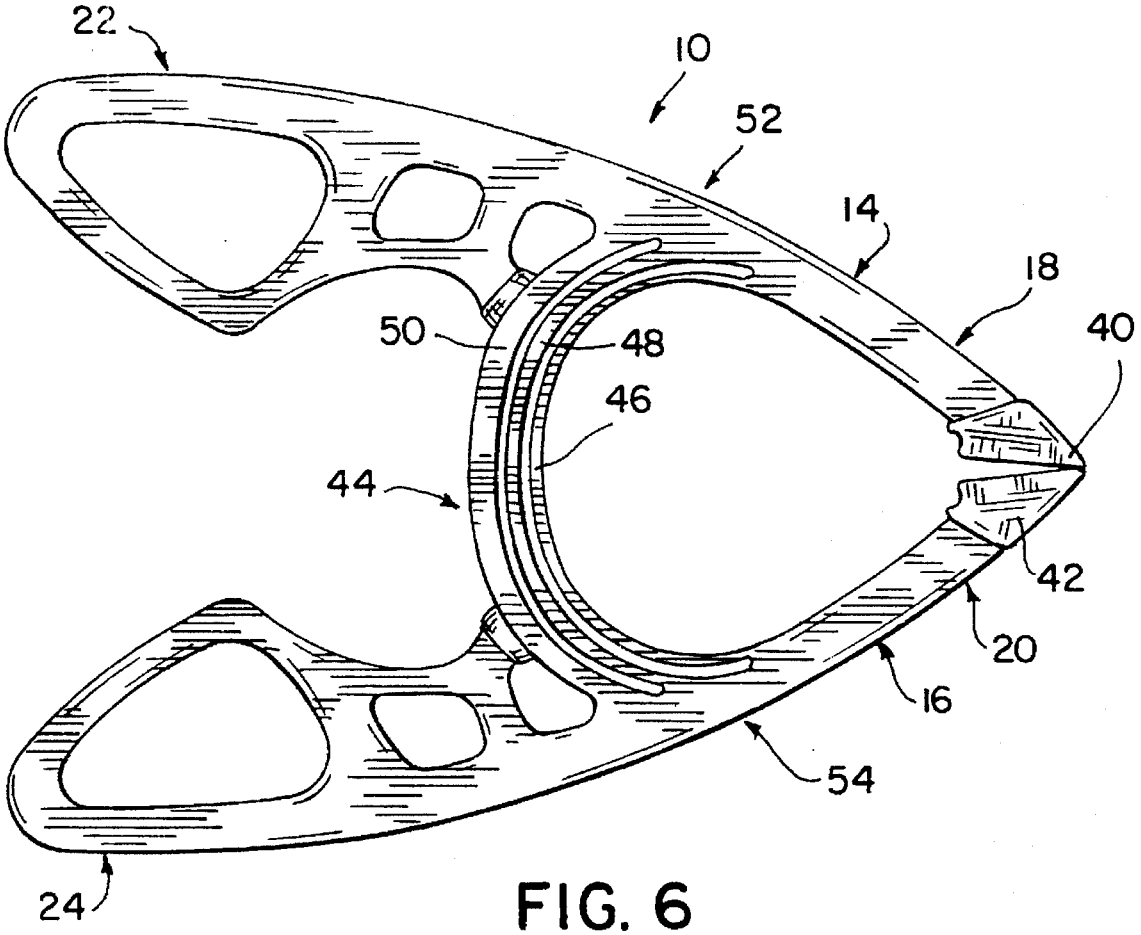
FIG. 6 is a front elevational view of a clamp in accordance with a third embodiment of the invention.

The invention relates to clamps having a pair of elongated members, each member having a working end and an opposed force applying end. The members are interconnected by a plurality of flexible bands thereby creating a compliant mechanism which conveniently biases the clamp in a closed configuration. Accordingly, the term "clamp" as used herein from time to time should also be understood to connote other types of implements such as grips, vises, braces, or the like, which include such a compliant mechanism.

Similarly, "plastic" includes any flowable polymer, copolymers and the like, and "rubber-like" material further comprehends similar materials including, for example, Kraton® from Shell Oil Company of New York, N.Y., Santoprene® from Advanced Elastomer Systems Inc. (formerly Monsanto Company of St. Louis, Mo.), or other suitable material which can be utilized to with the jaws and braces.

In this vein, those skilled in the art will further appreciate that the device described herein and its principle of operation is broadly applicable to a wide variety of devices having resiliently biased members, and may be adapted to devices other than the clamps specifically referred to herein. Accordingly, while the present invention is hereinafter described with particular reference to a clamp, the skilled artisan will note its many other applications.

Referring to the Figures, a clamp 10 according to the invention having a longitudinal axis 12 includes a pair of opposed elongated members 14, 16, each member having a working end 18, 20, and an opposed force applying end 22, 24. Member 14 has oppositely facing inner and outer faces 26, 28, while similarly, member 16 has oppositely facing inner and outer faces 30, 32. Clamp 10 is also advantageously provided with handles 34, 36 at force applying ends 22, 24. A plurality of apertures 38 may be formed in handles 34, 36 to assist a user in grasping and controlling clamp 10. Handles 34, 36 also include oppositely facing abutment faces 35, 37 which come into contact upon full convergence of the handles, i.e, when clamp 10 is fully open. At the opposite end of clamp 10, working ends 18, 20 may be provided with jaws 40, 42 made of a rubber-like material such as Santoprene which is overmolded onto ends 18, 20.

As shown on FIG. 1, members 14, 16 are interconnected by a joint 44 comprising a plurality of arcuately-shaped bands or links 46–50 in a region 52, 54 of members 14, 16 intermediate working ends 18, 20 and force applying ends 22, 24. Bands 46–50 have oppositely facing and spaced apart inner and outer surfaces 46*a*, 46*b*; 48*a*, 48*b*; and 50*a*, 50*b*. Members 14, 16 must be of sufficient thickness, relative to that of bands 46–50, to provide adequate functional rigidity to clamp 10.

In the preferred embodiment, bands 46–50 are substantially concentric so that the inner surface of the innermost band, i.e. 46*a* as illustrated in FIG. 2 faces working ends 18, 20, while outer surface 50*b* faces force applying ends 34, 36. In other words, in the preferred embodiment, bands 46–50 are substantially concentric about a point which lies in a region 56 of clamp 10 intermediate working ends 18, 20 and regions 52, 54, i.e. in the bight 56 formed by joint 44. Bands 46–50 may instead be ellipsoidally-shaped, as shown in FIG. 6, or generally arcuately-shaped. In all these cases, however, preferably inner surfaces 46*a*, 48*a*, and 50*a*, will form an obtuse angle with inner faces 26, 30 to reduce stresses in regions 52, 54.

As more particularly shown in FIGS. 1 and 2, band 50 has a thickness which is greater than that of band 46, while intermediate band 48 is preferably of a thickness intermediate that of bands 46 and 50. This is because the greatest amount of flexibility is required of innermost band 46 upon opening of clamp 10, as illustrated in FIG. 3. Bands 46–50 may, however, be of equal thickness without significantly impairing operation of clamp 10.

To limit creeping of plastic joint 44 in the event clamp 10 is kept open for an extended period of time, clamp 10 may also include a metal spring 58 preferably configured as a metal band. Spring 58 may be removably secured to clamp 10 by a plurality of tabs 60. Alternatively, spring 58 can be overmolded thereby forming part of bands 44, 46, or 48. Yet as another way to address a potential "creep" in plastic joint 44, clamp 10 may be made out of fiberglass filed plastic in which the glass fibers in bands 46–50 are oriented longitudinally therewith.

Clamp 10 further includes a pair of braces 62, 64, each having a stem 66, 68 connected to members 22, 24, and merging into a head 70, 72. Preferably heads 70, 72 are made of rubber-like material such as Santoprene which is overmolded onto stems 66, 68. Braces 62, 64 provide structural support to outermost band 50 to reduce stress induced in band 50 by the opening of clamp 10 and limit undue deformation of band 50. Braces 62, 64, thereby effectively transform band 50 from a beam supported only in regions 52, 54, into a structure comprising three shorter beams.

Clamp 10 operates as follows. From the closed position shown in FIG. 1, the user may open clamp 10 by squeezing handles 34, 36, to separate working ends 18, 20 as required, depending on the size of the work piece to be received within jaws 40, 42. During that operation which is illustrated in FIG. 3, joint 44 flexes so that innermost band 46 and intermediate band(s) 48 go into tension while outermost band 50 goes into compression. Kinetic energy is thereby stored into bands 46–50. When the user brings jaws 40, 42 into contact with the work piece, bands 46–50 release that stored energy to securely, yet gently, maintain the work piece clamped in place within jaws 40, 42. In the event of shrinkage of the work piece, more kinetic energy is released. As a result the pressure applied by jaws 40, 42 onto the work piece is substantially constant. In the alternative configuration where clamp 10 also includes braces 62, 64, during opening of clamp 10, heads 70, 72 come into contact with outermost band 50 thereby reducing undue stress in band 50 and permitting wider opening of jaws 40, 42.

It can therefore be readily appreciated from the foregoing description of the present invention that because bands 46–50 are flexible, clamp 10 is self-adjusting about work pieces of a wide variety of configurations. This construction also permits the user to place the clamp about the work piece without any clamping force adjustment, in a one-handed operation.

A resilient clamp such as the clamp according to the present invention therefore alleviates some of the shortcomings found in the prior art and in particular permits one-hand operation and improves retention of the work piece within the clamp in the event of shrinkage of the work piece. The unitary configuration also reduces overall manufacturing costs. Thus, these novel features should facilitate use of such clamps and also favorably affect other characteristics which are important to users of these clamps.

It is understood that the above description is of a preferred exemplary embodiment of the invention, and that the invention is not limited to the specific forms described. Those skilled in the art will appreciate that, for example, clamps in accordance with the invention could comprise members, a joint, handles, and jaws, configured in ways other than those described in the preferred embodiment. For example, joint 44 could be formed as explained earlier of arcuately-shaped bands other than semi-circular bands, and could comprise more that three bands. In addition, jaws 40, 42 could be configured to closely conform to the shape of a particular work piece with which the clamp is repeatedly used. Likewise, members 14, 16 and handles 34, 36, could have different configurations, as required by the particular application, in each and every cases without departing from the scope of this invention. Such other configurations and constructions are considered to be within the scope of this invention. Thus, these and other substitutions, modifications, changes and omissions may be made in the design and arrangement of the elements and in the manufacturing steps disclosed herein without departing from the scope of the appended claims.

We claim:

1. A resilient clamp, comprising:

a pair of oppositely facing elongated members, each member having a working end and an opposed force applying end;

a plurality of spaced apart bands resiliently joining the members in a region of the members intermediate the working ends and the force applying ends, wherein the bands are generally arcuately-shaped about a point lying intermediate the working ends and the region, the plurality of spaced apart bands including an outermost band having oppositely facing and spaced apart inner and outer surfaces; and a pair of braces connected to the members and extending inwardly therefrom by a predetermined distance such that the braces engage the outer surface of the outermost band during convergence of the force applying ends.

2. The clamp of claim 1, further having a longitudinal axis and wherein the point lies on the axis.

3. The clamp of claim 1, wherein the bands are substantially of equal thickness.

4. The clamp of claim 1, wherein the plurality of bands comprises an innermost band, an outermost band, and at least one intermediate band disposed intermediate the innermost and outermost bands, the inner surface of the innermost band facing the point.

5. The clamp of claim 4, wherein the outermost band is thicker than the innermost band.

6. The clamp of claim 4, wherein the bands are of progressively increasing thickness from the innermost to the outermost.

7. The clamp of claim 1, wherein at least one of the bands is a metal spring.

8. The clamp of claim 1, wherein each brace includes a stem and a head, the heads being engageable with the outermost band.

9. The clamp of claim 1, wherein the braces are formed integrally with the members.

10. The clamp of claim 1, wherein the bands are formed integrally with the members.

11. The clamp of claim 1, wherein the bands are substantially semi-circular.

12. The clamp of claim 1, wherein the bands are substantially semi-ellipsoidal.

13. The clamp of claim 1, wherein the clamp is made of a moldable material.

14. The clamp of claim 13, wherein the moldable material is a plastic.

15. The clamp of claim 14, wherein the plastic includes glass fibers, the fibers of the bands being oriented substantially longitudinally with the inner and outer surfaces of the bands.

16. The clamp of claim 1, wherein the members further include jaws at the working ends thereof, the jaws being made of a rubber-like material.

17. A unitary resilient clamp, comprising:

first and second elongated members, each member including a force applying end and an opposed working end having a jaw; and a resilient joint formed integrally with the members, the joint interconnecting the members in a region of the members intermediate the working ends and the force applying ends, the joint comprising at least one arcuately-shaped band defining a bight facing the jaws;

wherein each member further includes a handle at the force applying end thereof, the handles having oppositely facing abutment faces projecting inwardly therefrom and inter-engaging upon full convergence of the handles to limit opening of the jaws.

18. The clamp of claim 17, wherein the joint comprises a plurality of substantially concentric bands.

19. The clamp of claim 17, wherein the joint comprises a plurality of equidistantly offset, ellipsoidally-shaped, bands.

20. The clamp of claim 17, wherein the clamp further includes a pair of braces connected to the members and extending inwardly therefrom by a predetermined distance such that the braces engage an outermost band of the joint while the jaws are being separated in response to convergence of the force applying ends.

21. The clamp of claim 19, further including a plurality of apertures formed therein in a region of the members proximate the force applying end.

22. A clamp for releasably clamping a work piece, the clamp comprising:

a pair of elongated members, each member having a force applying end and an opposed working end having a jaw; and means for developing a force to establish suitable contact between the jaws and the work piece, wherein the means for developing a force includes a plurality of spaced apart, concentric, and substantially arcuately-shaped bands resiliently joining the members in a region of the members intermediate the working ends and the force applying ends;

the plurality of bands including an innermost band, an outermost band, and at least one intermediate band disposed intermediate the innermost and outermost bands, the outermost band having a thickness greater than the innermost band;

the bands being of progressively increasing thickness from the innermost band to the outermost band, each band having a substantially uniform thickness.

23. The clamp of claim 20, wherein the bands are formed integrally with the members.

24. The clamp of claim 22, wherein the bands are substantially semi-circular when the clamp is in closed configuration.

25. The clamp of claim 22, wherein at least one of the bands is a metal spring.

* * * * *